US006147453A

United States Patent [19]

Geijtenbeek et al.

[11] Patent Number: 6,147,453

[45] Date of Patent: Nov. 14, 2000

[54] METAL-HALIDE LAMP WITH LITHIUM AND CERIUM IODIDE

[75] Inventors: Johannes J. F. Geijtenbeek; Fransiscus A. Vermeulen, both of Eindhoven, Netherlands

[73] Assignee: U.S. Philips Corporation, New York, N.Y.

[21] Appl. No.: 09/196,065

[22] Filed: Nov. 19, 1998

[30] Foreign Application Priority Data

Dec. 2, 1997 [EP] European Pat. Off. ..... 97203774

[51] Int. Cl.[7] ..... H01J 61/18

[52] U.S. Cl. ..... 313/640; 313/620

[58] Field of Search ..... 313/620, 606, 313/638, 639, 640, 641, 642

[56] References Cited

U.S. PATENT DOCUMENTS

| | | | |
|---|---|---|---|
| 5,424,609 | 6/1995 | Geven et al. | 313/623 |
| 5,451,838 | 9/1995 | Kawai | 313/640 |
| 5,973,453 | 10/1999 | VanVliet et al. | 313/623 |

FOREIGN PATENT DOCUMENTS

| | | | |
|---|---|---|---|
| 0215524 | 3/1987 | European Pat. Off. | H01J 61/30 |

*Primary Examiner*—Michael H. Day

[57] ABSTRACT

Metal halide lamp includes a discharge vessel having a ceramic wall with an internal diameter Di and enclosing two electrodes whose tips are a distance EA apart, wherein EA/Di>5. The vessel has a filling comprising Hg, CeI, and LiI.

7 Claims, 2 Drawing Sheets

METAL-HALIDE LAMP WITH LITHIUM AND CERIUM IODIDE

BACKGROUND OF THE INVENTION

The invention relates to a metal-halide lamp comprising a discharge vessel with a ceramic wall which encloses a discharge space with an ionizable filling including at least Hg, an alkali halide and $CeI_3$, and which discharge space further accommodates two electrodes whose tips are arranged at a mutual distance EA, and the discharge vessel has an inside diameter Di at least over the distance EA, and the relation EA/Di>5 is met.

A lamp of the type mentioned in the opening paragraph is known from the European patent application No. 96203434.4 (U.S. Ser. No. 08/982,563, now U.S. Pat. No. 5,973,453). The known lamp, which combines a high luminous efficacy with acceptable to good color properties (inter alia a general color rendering index $R_a \geqq 45$ and a color temperature $T_c$ in the range between 2600 and 4000 K) can particularly suitably be used as a light source for, inter alia, general lighting purposes. As a result of the comparatively small diameter with respect to the electrode distance and hence the discharge arc length, the discharge arc is restrained by the wall of the discharge vessel, and it is attained that the discharge arc has an approximately straight shape. This is very advantageous in connection with the Ce present, since Ce generally has a strong contracting influence on the discharge arc of the lamp. In general, it applies that a discharge arc will exhibit a greater degree of curvature in the horizontal burning position as the degree of contraction of said discharge arc is greater. It has also been found that, as a result of this geometry, the wall of the discharge vessel is subject to such uniform heating that the risk of fracture of the wall of the discharge vessel as a result of thermal stress is very small. It has further been found that said geometry also substantially counteracts the occurrence of spiral-shaped instabilities in the discharge.

By restraining the discharge arc, use is advantageously made of a good thermal conductivity of the ceramic of the wall of the discharge vessel as a means of limiting thermal stresses in the wall of the discharge vessel.

In this description and in the claims, the term ceramic wall is to be understood to mean both a wall of metal oxide, such as sapphire or dense-sintered polycrystalline $Al_2O_3$, and a wall of metal nitride, such as AlN. These materials can very suitably be used to manufacture gastight translucent bodies. The light emitted by the known lamp has a color point with co-ordinates (x,y) which differs so much from the color point of the light emitted by a full radiator that it cannot suitably be used for indoor lighting. The collection of color points of a full radiator is commonly referred to as black-body-line (BBL). For indoor lighting purposes, it applies that only light whose color point deviates only slightly from BBL is to be considered as white light. Therefore, in general, it applies for indoor lighting applications that the color point co-ordinates (x,y) deviate maximally (0.03; 0.03) and preferably not more than (0.015; 0.015) from the BBL at the same color temperature $T_c$.

In the known lamp, use has been made of the insight, which is known per se, that a good color rendering can be achieved if the alkali halide is used in the form of Na-halide as the filling constituent of a lamp, and that during operation of the lamp a strong broadening and reversal of the Na-emission in the Na-D lines occurs. This requires a high temperature of the coldest spot $T_{kp}$ in the discharge vessel of at least 1100 K (820° C.).

The requirement of a high value of $T_{kp}$ excludes, under practical conditions, the use of quartz or quartz glass for the wall of the discharge vessel and compels the use of ceramic for the wall of the discharge vessel.

EP-A-0215524 (PHN 11.485) discloses a metal-halide lamp in which use is made of the above-described insight, and which lamp has excellent color properties (inter alia, general color-rendering index $R_a \geqq 80$ and a color temperature $T_c$ in the range between 2600 and 4000 K) and hence can very suitably be used as a light source for, inter alia, indoor lighting. Said known lamp has a relatively short discharge vessel for which applies that $0.9 \leqq EA/Di \leqq 2.2$, and a high wall load which, for practical lamps, amounts to more than 50 W/cm$^2$. In said application, the wall load is defined as the quotient of the wattage of a lamp and the outer surface of the part of the wall of the discharge vessel located between the electrode tips.

A drawback of this lamp is that it has a relatively limited luminous efficacy.

Metal-halide lamps with a filling comprising not only an alkali metal and Ce, but also Sc, and with a color point which is very close to the BBL, are known per se. However, as a result of its very strong reactive character, Sc proved to be unsuitable for use in a metal-halide lamp having a ceramic lamp vessel.

SUMMARY OF THE INVENTION

The invention relates to a measure for obtaining a metal-halide lamp having a high luminous efficacy, which can suitably be used for indoor lighting applications.

To achieve this, the alkali-halide comprises lithium iodide (LiI).

By means of this measure, the lamp emits light with a high luminous efficacy and with a color point which is so close to the BBL that the light emitted by the lamp can be considered to be white light for indoor lighting applications. This is further favorably influenced by the choice of LiI and $CeI_3$ in a molar ratio ranging between 1 and 8. In an advantageous embodiment of the lamp in accordance with the invention, the alkali halide also comprises NaI. Apart from the preservation of a color point which is so close to the BBL that the lamp can be used for indoor lighting purposes, the presence of NaI enables the color point of the lamp to be chosen in a wide range along the BBL. Preferably, LiI and NaI are jointly present in a molar ratio relative to $CeI_3$ ranging between 4 and 10. This enables a lamp to be obtained whose emitted light has a color point whose co-ordinates differ less than (0.015; 0.015) from the BBL, while the color temperature of the light ranges between 3000 K and 4700 K.

Counteracting thermal stresses in the wall of the discharge vessel is further favorably influenced by choosing the wall load to be preferably maximally 30 W/cm$^2$.

A further improvement as regards the control of the wall temperature and of thermal stresses in the wall of the discharge vessel can be achieved by a suitable choice of the wall thickness. The good thermal conductivity of the ceramic wall is further advantageously used if the ceramic wall has a thickness of at least 1 mm. An increase of the wall thickness results in an increase of the thermal radiation through the wall of the discharge vessel, but above all it contributes to a better heat transport from the part of the wall between the electrodes to the relatively cool ends of the discharge vessel. In this manner, it is achieved that the temperature difference occurring at the wall of the discharge vessel is limited to approximately 200 K. An increase of the wall thickness also leads to a decrease of the load on the wall.

Also an increasing ratio EA/Di by increasing EA causes the load on the wall to be limited. In this case, an increasing radiation loss at the wall of the discharge vessel and hence an increasing heat loss of the discharge vessel during operation of the lamp will occur. Under otherwise constant conditions, this will lead to a decrease of $T_{kp}$.

To obtain a high luminous efficacy and good color properties, it is necessary for the discharge to contain sufficiently large concentrations of Li, Na and Ce. Since the halide salts are present in excess, this is achieved by the magnitude of $T_{kp}$. It has been found that, during operation of the lamp, $T_{kp}$ assumes a value of at least 1100 K. Particularly to attain a sufficiently high vapor pressure of Ce, preferably, a value for $T_{kp}$ of 1200 K or more is realized.

Also bearing in mind the strong dependence of the Ce vapor pressure upon the temperature, it is not necessary to employ very high values of $T_{kp}$, which is favorable for obtaining a long service life of the lamp. In any case, attention should be paid that $T_{kp}$ is lower than the maximum temperature which the ceramic wall material can withstand for a long period of time.

Further experiments have shown that it is desirable not to exceed 1500 K as the maximum value for $T_{kp}$. If $T_{kp}$>1500 K, the temperatures and pressures in the discharge vessel assume values such that occurring chemical processes attacking the wall of the discharge vessel give rise to an unacceptable reduction of the service life of the lamp. Preferably, if densely sintered $Al_2O_3$ is used for the wall of the discharge vessel, the maximum value of $T_{kp}$ is 1400 K.

In general, a noble gas for ignition of the lamp is added to the ionizable filling of the discharge vessel. The choice of the filling pressure of the noble gas enables the light-technical properties of the lamp to be influenced.

DETAILED DESCRIPTION OF THE PREFERRED EMBODIMENTS

Figure 1:
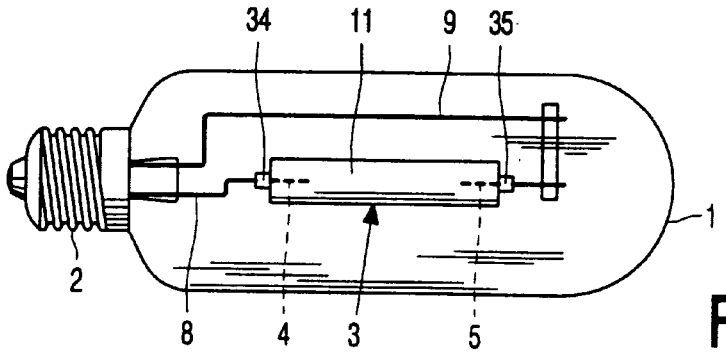
FIG. 1 schematically shows a lamp in accordance with the invention.
Figure 2:
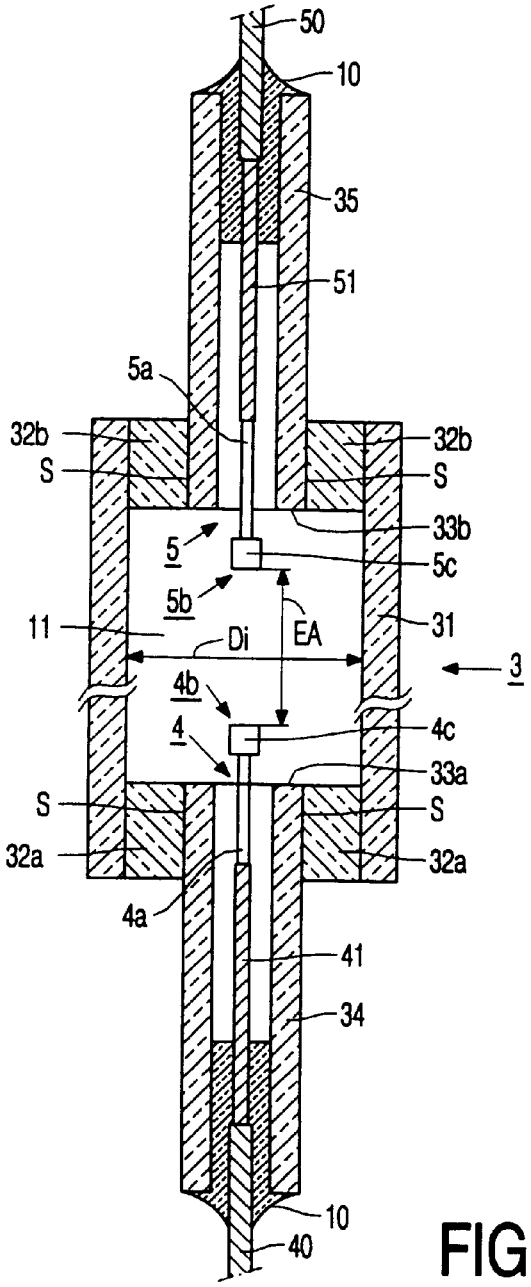
FIG. 2 is a detailed representation of the discharge vessel of the lamp in accordance with FIG. 1.

FIG. 1 shows a metal-halide lamp provided with a discharge vessel 3 having a ceramic wall which encloses a discharge space 11 containing an ionizable filling including at least Hg, an alkali halide and $CeI_3$. Two electrodes whose tips are at a mutual distance EA are arranged in the discharge space, and the discharge vessel has an internal diameter Di at least over the distance EA. The discharge vessel is closed at one side by means of a ceramic projecting plug 34, 35 which encloses a current lead-through conductor (FIG. 2: 40, 41, 50, 51) to an electrode 4, 5 positioned in the discharge vessel with a narrow intervening space and is connected to this conductor in a gastight manner by means of a melting-ceramic joint (FIG. 2: 10) near to an end remote from the discharge space. The discharge vessel is surrounded by an outer bulb 1 which is provided with a lamp cap 2 at one end. A discharge will extend between the electrodes 4, 5 when the lamp is operating. The electrode 4 is connected to a first electrical contact forming part of the lamp cap 2 via a current conductor 8. The electrode 5 is connected to a second electrical contact forming part of the lamp cap 2 via a current conductor 9. The discharge vessel, shown in more detail in FIG. 2 (not true to scale), has a ceramic wall and is formed from a cylindrical part with an internal diameter Di which is bounded at either end by a respective end wall portion 32*a*, 32*b*, each end wall portion 32*a*, 32*b* forming an end surface 33*a*, 33*b* of the discharge space. The end wall portions each have an opening in which a ceramic projecting plug 34, 35 is fastened in a gastight manner in the end wall portion 32*a*, 32*b* by means of a sintered joint S. The ceramic projecting plugs 34, 35 each narrowly enclose a current lead-through conductor 40, 41, 50, 51 of a relevant electrode 4, 5 having a tip 4*b*, 5*b*. The current lead-through conductor is connected to the ceramic projecting plug 34, 35 in a gastight manner by means of a melting-ceramic joint 10 at the side remote from the discharge space.

The electrode tips 4*b*, 5*b* are arranged at a mutual distance EA. The current lead-through conductors each comprise a highly halide-resistant portion 41, 51, for example in the form of a Mo—$Al_2O_3$ cermet and a portion 40, 50 which is fastened to a respective end plug 34, 35 in a gastight manner by means of the melting-ceramic joint 10. The melting-ceramic joint extends over some distance, for example approximately 1 mm, over the Mo cermet 41, 51. It is possible for the parts 41, 51 to be formed from a material other than Mo—$Al_2O_3$ cermet. Other possible constructions are known, for example, from U.S. Pat. No. 5,424,609. A particularly suitable construction was found to be, inter alia, a highly halide-resistant coil applied around a pin of the same material. Mo is very suitable for use as a highly halide-resistant material. The parts 40, 50 are made from a metal whose coefficient of expansion corresponds well to that of the end plugs. Nb, for example, is a highly suitable material. The parts 40, 50 are connected to the current conductors 8, 9, respectively, in a manner not shown in any detail. The lead-through construction described renders it possible to operate the lamp in any desired burning position. Each of the electrodes 4, 5 comprises an electrode rod 4*a*, 5*a* which is provided with a winding 4*c*, 5*c* near the tip 4*b*, 5*b*. The projecting ceramic plugs are fastened in the end wall portions 32*a* and 32*b* in a gastight manner by means of a sintered joint S. The electrode tips then lie between the end surfaces 33*a*, 33*b* formed by the end wall portions.

In a practical realization of a lamp according to the invention as shown in the drawing, the rated lamp power is 150 W. The lamp, which is suitable for being operated in an existing installation for operating a high-pressure sodium lamp, has a lamp voltage of 105 V. The ionizable filling of the discharge vessel comprises 0.7 mg Hg (<1.6 mg/cm$^3$) and 13 mg iodide salts of Li and Ce in a molar ratio of 5.5:1. The Hg serves to ensure that the lamp voltage will be between 80 V and 110 V, which is necessary to ensure that the lamp can be operated in an existing installation for operating a high-pressure sodium lamp. In addition, the filling comprises Xe with a filling pressure of 250 mbar as an ignition gas.

The electrode tip interspacing EA is 32 mm, the internal diameter Di 4 mm, so that the ratio EA/Di=8. The wall thickness of the discharge vessel is 1.4 mm. The lamp accordingly has a wall load of 21.9 W/cm$^2$.

The lamp has a luminous efficacy of 104 lm/W in the operational state. The light emitted by the lamp has values for $R_a$ and $T_c$ of 96 and 4700 K, respectively. The light emitted by the lamp has a color point (x,y) with values (0.353, 0.368), which, at a constant temperature, deviates less than (0.015, 0.015) from the color point (0.352; 0.355) on the black-body line.

Figure 3:
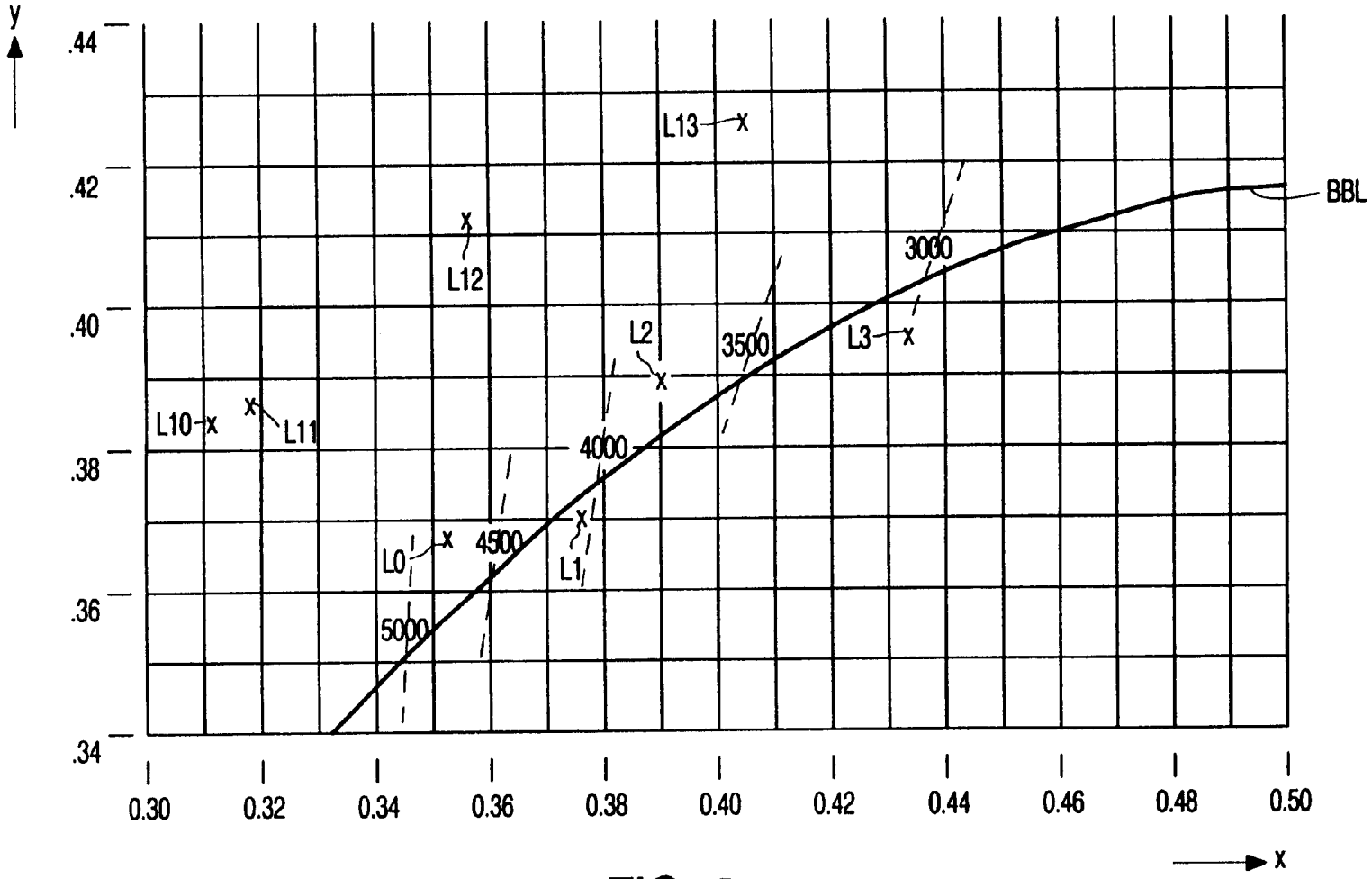
FIG. 3 shows a graph of co-ordinates of color points of the lamp in accordance with the invention.

In FIG. 3, the color point of the lamp is referenced L0. In the graph, which represents a part of the color triangle, the x-co-ordinate of the color point is plotted on the horizontal axis and the y-co-ordinate of the color point is plotted on the vertical axis. BBL indicates the black-body line. Dashed lines indicate lines of a constant color temperature $T_c$ in K. L1, L2 and L3 indicate color points of, respectively, lamps L1, L2 and L3 with an ionizable filling containing LiI, NaI and $CeI_3$. The molar ratio $LiI/CeI_3$ and $NaI/CeI_3$ is, successively, 6 and 1, respectively, for L1, 2.9 and 3, respectively, for L2 and 2.4 and 7, respectively, for L3. For comparison, L11, L12 and L13 denote color points of lamps L11, L12 and L13, respectively, in accordance with the state of the art, in which the discharge vessel only comprises the halides of Na and Ce. The molar ratio $NaI/CeI_3$ is 1 for L11, 3 for L12 and 7 for L13. Finally, L10 indicates the color point of a lamp L10 comprising only $CeI_3$ as the halide. A Table lists the light-technical data of the lamps shown in the graph.

TABLE

| Lamp No | Luminous efficacy (lm/W) | $R_a$ (K) | $T_c$ (x;y) | Color point co-ordinates |
|---|---|---|---|---|
| L 0 | 104 | 96 | 4700 | .353; .368 |
| L 1 | 106 | 92 | 4100 | .377; .37 |
| L 2 | 117 | 80 | 3800 | .39 ; .389 |
| L 3 | 114 | 64 | 3000 | .433; .395 |
| L10 | 97 | 69 | 6300 | .312; .383 |
| L11 | 113 | 71 | 6100 | .318; .386 |
| L12 | 133 | 69 | 4800 | .356; .411 |
| L13 | 134 | 59 | 3800 | .405; .426 |

The lamps listed in the Table all have a discharge vessel of the same construction, the same rated power and a lamp voltage in the range between 80 V and 110 V. The temperature of the coldest spot $T_{kp}$ ranges from 1200 K to 1250 K. The discharge vessel of the lamps has a wall thickness of 1.4 mm, and the temperature difference occurring at the wall of the discharge vessel is approximately 150 K.

From the data listed in the Table it can be derived that lamps in accordance with the invention have a substantially improved color point, while retaining a relatively high luminous efficacy, as compared to lamps in accordance with the prior art U.S. Ser. No. 08/982,563, now U.S. Pat. No. 5,973,453. For lamps having the same quantity of NaI, the reduction in luminous efficacy ranges between 5% and 15%. The lamps in accordance with the invention have a luminous efficacy which is comparable to that of commonly used high-pressure sodium lamps of which the luminous efficacy generally ranges from 100 lm/W to 130 lm/W.

Finally, it is noted that, for example, for a color temperature of 3000 K the color point on the BBL has the co-ordinates (0.437; 0.404). The color point of lamp L3 deviates only (0.004; 0.009) from these values.

What is claimed is:

1. A metal-halide lamp comprising a discharge vessel with a ceramic wall which encloses a discharge space with an ionizable filling including at least Hg, an alkali halide and $CeI_3$, and which discharge space further accommodates two electrodes whose tips are arranged at a mutual distance EA, and the discharge vessel has an inside diameter Di at least over the distance EA, and the relation EA/Di>5 is met, characterized in that the alkali halide comprises LiI.

2. A lamp as claimed in claim 1, wherein LiI and $CeI_3$ are present in a molar ratio ranging between 1 and 8.

3. A lamp as claimed in claim 1 wherein the alkali halide also comprises NaI.

4. A lamp as claimed in claim 3, wherein LiI and NaI are jointly present in a molar ratio relative to $CeI_3$ ranging between 4 and 10.

5. A lamp as claimed in claim 1, wherein the discharge vessel of the lamp has a wall load $\leqq 30$ W/cm$^2$.

6. A lamp as claimed in claim 1, wherein, at least over the distance EA, the wall of the ceramic discharge vessel has a thickness of minimally 1 mm.

7. A lamp as claimed in claim 1, wherein LiI, NaI and $CeI_3$ are present in excess, and that, during operation of the lamp, there is a temperature of the coldest spot $T_{kp}$ of minimally 1100 K and maximally 1500 K at the location of the excess.

* * * * *